United States Patent [19]

Sella

[11] Patent Number: 4,699,517

[45] Date of Patent: Oct. 13, 1987

[54] PEDAL LOCKING AND UNLOCKING ASSEMBLY IN A MORTAR AND PLASTER MIXING MACHINE

[76] Inventor: Lino Sella, Via Riviera, Beria 24-Ponte di Mossano (VI), Italy

[21] Appl. No.: 798,985

[22] Filed: Nov. 18, 1985

[30] Foreign Application Priority Data

Oct. 24, 1985 [IT] Italy ..... 64401/85[U]

[51] Int. Cl.[4] ..... B28C 7/16; B01F 15/02

[52] U.S. Cl. ..... 366/45; 366/185

[58] Field of Search ..... 366/45, 185, 189

[56] References Cited

U.S. PATENT DOCUMENTS

| | | | |
|---|---|---|---|
| 1,725,681 | 8/1929 | St John | 366/45 |
| 1,928,950 | 10/1933 | O'Neill | 366/185 |
| 3,717,329 | 2/1973 | Margittai | 366/185 |

FOREIGN PATENT DOCUMENTS

| | | | |
|---|---|---|---|
| 1169826 | 9/1962 | Fed. Rep. of Germany | 366/45 |

*Primary Examiner*—H. Hampton Hunter

*Attorney, Agent, or Firm*—Birch, Stewart, Kolasch & Birch

[57] ABSTRACT

A pedal latching mechanism for a machine to mix mortar and plaster, which includes a latch activated by a pedal lever, the latch mechanism including a rod biased against the vertical surface of the drum of the mixer and engages with a protuberance formed by a piece of metal welded to the vertical surface of the drum and bent in such a way as to form an inclined plane.

During the rotation movement of the drum for the unloading of the mortar, the latch which is locked by the pedal, remains in contact with the surface of the inclined plane at first and then with the vertical surface of the piece of metal. When the drum returns to the upright position, the latch resumes automatically its latching position against the protuberance since it is biased by a spring.

9 Claims, 4 Drawing Figures

PEDAL LOCKING AND UNLOCKING ASSEMBLY IN A MORTAR AND PLASTER MIXING MACHINE

BACKGROUND OF THE INVENTION

The invention relates to a pedal locking and unlocking device for mortar and plaster mixing machines, consisting essentially of mainly cylindrical drums, inside which a rotating shaft equipped with appropriate blades and activated by an electric or gas motor, mixes the mortar contained therein.

The unloading of the mixed substance occurs by gravity by manually rotating the drum around its supporting axle. During the mixing operation both the rotating shaft and the moving substance inside the drum exert a thrust which tends to make the drum rotate also; it is, therefore, necessary to prevent said rotation and for this reason the drum is locked to its stands by means of latches or similar means. When the unloading operation is performed, the operator removes the locking means and operates the lever which causes the drum containing the mortar to rotate.

SUMMARY OF THE INVENTION

A goal of the present invention is that of equipping a mixing machine with new means for locking and unlocking the unloading of the drum containing the mortar. Another goal is that of obtaining that the locking and unlocking operations occur by means of a pedal, in order to allow the operator to rotate the drum for the unloading operation with both hands being free.

Yet another goal is that of obtaining that, when the drum having been emptied of the mortar returns to its upright position, the locking device automatically returns to engage the drum. These and other advantages of the invention, which will be better illustrated hereafter, are reached in the construction of a pedal locking and unlocking device, which, in accordance with the patent claims, is characterized by the inclusion of a device having a lever being pivoted on a post supporting the mixing machine, said lever presenting a pedal at one end and, at the other end, a latch consisting of a horizontal pivot, which slides in a supporting tube being fastened to the post of the machine, said pivot being placed in contrast to the vertical surface of the drum and there being a protuberance on said vertical surface consisting of a bent piece of metal forming a slanted plane, said pivot being recalled against the surface of the drum by the action of a spring.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE INVENTION

The present invention will become more fully understood from the detailed description given herein below and the accompanying drawings which are given by a way of illustration only, and thus are not limitative of the present invention, and wherein.

DETAILED DESCRIPTION OF THE INVENTION

Figure 1:
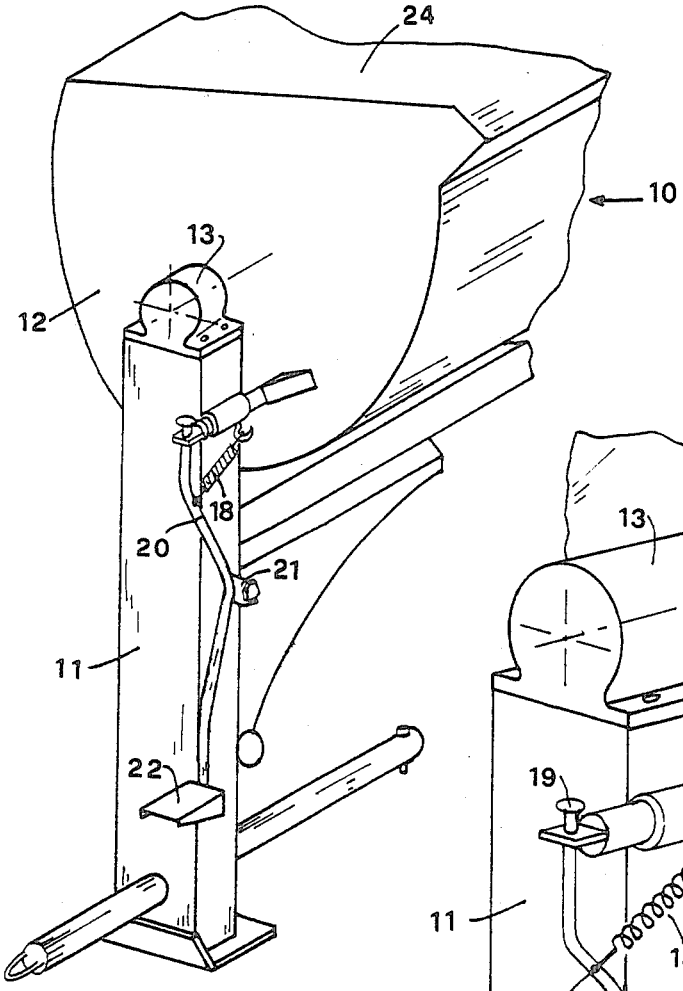
FIG. 1 is a partial perspective view of a mixing machine equipped with the device being the object of the present invention.
Figure 2:
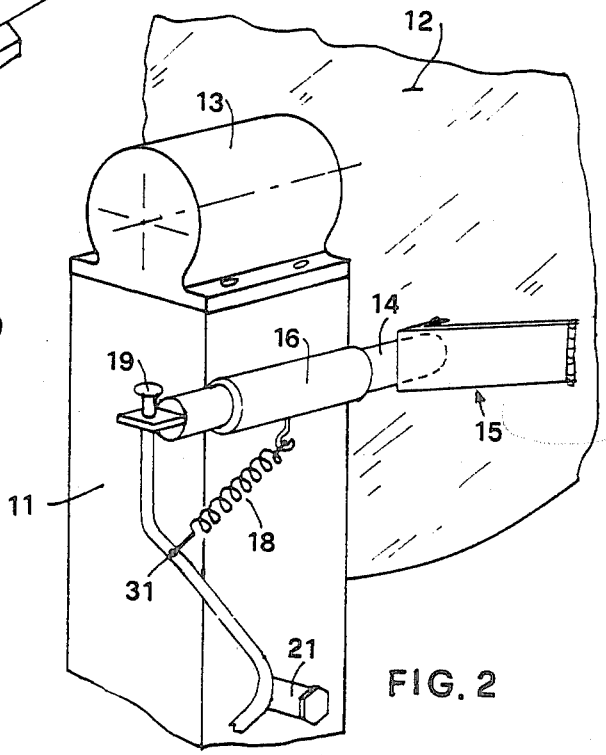
FIG. 2 shows in perspective the detail of the latch and of the catch on the drum.

With reference to FIG. 1, where the mortar mixing machine is indicated as a whole with 10 and one side of the support stand of said machine is indicated. It can be observed that drum 12 containing the mortar can rotate around pivot supports 13, only one of which is visible in FIG. 1. Pivot supports 13 are connected to posts 11 and are placed above the center of gravity of the drum 12. When the mixing machine is in operation, opening 24 is positioned on the upper part in the vertical direction. Since inside the drum, as it is known, a shaft holding some blades rotates for the mixing of the mortar mass, the drum would tend to rotate also, if it were not stayed by some appropriate catches. The anti-clockwise rotation of the drum is prevented in the known way by two stays engaging one against the other and which are placed, one on the post not being represented in FIG. 1 and the other on the vertical surface of the drum.

The clockwise rotation, which also corresponds to the direction of rotation necessary for the emptying operation, is prevented by the presence of a latch consisting of rod 14 which engages itself on a protuberance formed by a piece of metal 15 being welded to the vertical surface of the drum and bent so as to form a slanted plane.

Figure 3:
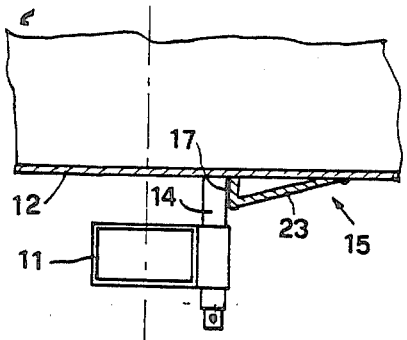
FIG. 3 is a cross section of the latch in its locked position.

When it is in its latching position, which corresponds to the mixing process of the machine, rod 14 protrudes from its housing in the supporting tube 16 and it engages the upright surface 17 (see FIG. 3) of the bent piece of metal 15, said surface being almost perpendicular to rod 14. Rod 14 is kept resting against the bent piece of metal 15 by the biasing action of spring 18, which biases the pivot against the vertical wall of drum 12 by means of end 19 of the pedal lever 20, which is pivoted on pivot 21. Spring 18 is connected to one end of the supporting tube 16, said tube being fastened as previously described to post 11, while the other end of spring 18 is connected to lever 20 at position 31.

Figure 4:
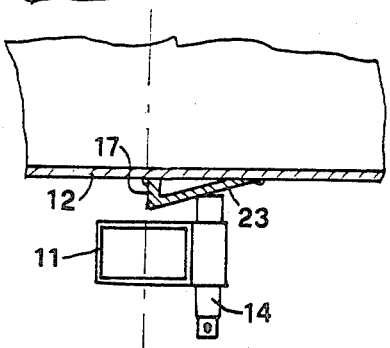
FIG. 4 is a cross section of the latch in its unlocked position.

When it is necessary to rotate drum 12 of the mixer, the operator presses pedal 22 with a foot, thereby causing lever 20 to rotate around pivot 21 and, as a consequence, rod 14 being connected to lever 19 slides back. As soon as the operator begins the clockwise rotation of the drum in order to empty it, the pedal is released and rod 14 biases, at first, against the inclined plane 23 of the bent piece of metal 15, as can be observed in FIG. 4, and then it goes on resting against the vertical surface of the drum. After the mortar has been unloaded, during the rotation in the opposite direction of drum 12 of the mixing machine, which resumes its position with opening 24 in the vertical position, rod 14 slides upwards along the slanted plane 23 and then, it being biased, by spring 18, it returns to rest against surface 17, as in its initial position and without any need for the operator to press the pedal again. The locking and unlocking devise being thus described, it is obvious that during the construction the same may be varied in many ways. Such variations are not to be regarded as a departure from the spirit and scope of the present invention, and all such modifications as would be obvious to one skilled in the art are to be included within the scope of the following claims.

I claim:

1. A mortar and plaster mixing apparatus comprising:

a drum;

support means for rotatably supporting said drum; and a latch mechanism comprising:

a rod and supporting tube, said rod having a first end and a second end and being slidably received within said supporting tube, said supporting tube being mounted to said support means;

a biasing means for biasing one end of said rod against said drum;

a protuberance attached to said drum for engaging with said rod for releasably locking said drum in a mixing position; and a release means for releasing said latch mechanism and allowing the drum to be rotated to a dumping position.

2. The apparatus according to claim 1, wherein said protuberance includes an inclined plane whereby said rod is biased against and rides said inclined plane upon rotating said drum from the dumping position to the mixing position for automatically locking said drum in the mixing position.

3. The apparatus according to claim 2, wherein said protuberance is formed by a bent piece of metal welded to said drum.

4. The apparatus according to claim 1, wherein said release means comprises:

a lever having a first end and a second end, said lever being pivotably mounted to said support means; and a pedal connected to said first end of said lever, said second end of said lever being connected to said second end of rod for retracting said rod away from said drum for releasing said latch mechanism against the biasing means upon activation of said pedal.

5. The apparatus according to claim 2, wherein said release means comprises:

a lever having a first end and a second end, said lever is pivotably mounted to said support means; and a pedal connected to said first end of said lever, said second end of said lever is connected to said second end of said rod for retracting said rod away from said drum for releasing said latch mechanism against the biasing means upon activation of said pedal.

6. The apparatus according to claim 1, wherein said support means comprises:

a pair of vertical posts with each post positioned on opposite sides of said drum and a pair of pivot supports, each pivot support being mounted on the top of each vertical post.

7. The apparatus according to claim 2, wherein said support means comprises:

a pair of vertical posts with each post positioned on opposite sides of said drum and a pair of pivot support, each pivot support is mounted on top of each vertical post.

8. The apparatus according to claim 5, wherein said support means comprises:

a pair of vertical posts with each post positioned on opposite sides of said drum and a pair of pivot support, each pivot support is mounted on top of each vertical post.

9. the apparatus according to claim 4, wherein said biasing means is a spring connected at one end to said supporting tube and connected at the other end to said lever at a position between a point at which said lever is pivotably mounted and said second end of said lever.

* * * * *